US006128788A

United States Patent [19]

Yamazaki

[11] Patent Number: 6,128,788

[45] Date of Patent: Oct. 10, 2000

[54] WATER CLOSET AND NURSING BED DEVICE WITH SAME

[75] Inventor: Kazuo Yamazaki, 1-1-61 Kusaka-cho, Higashiosaka-shi, Osaka, Japan

[73] Assignee: Kazuo Yamazaki, Japan

[21] Appl. No.: 09/297,023

[22] PCT Filed: Oct. 29, 1997

[86] PCT No.: PCT/JP97/03938

§ 371 Date: Apr. 23, 1999

§ 102(e) Date: Apr. 23, 1999

[87] PCT Pub. No.: WO98/19020

PCT Pub. Date: Jul. 5, 1998

[30] Foreign Application Priority Data

Oct. 30, 1996 [JP] Japan ..... 8-305765

[51] Int. Cl.[7] ..... E03D 1/00

[52] U.S. Cl. ..... 4/323; 4/352; 4/420.2; 4/434; 4/447; 4/547; 4/561.1

[58] Field of Search ..... 4/321, 323, 348, 4/352, 420.2, 420.4, 434, 443, 447, 547, 560.1, 561.1

[56] References Cited

U.S. PATENT DOCUMENTS

| | | | |
|---|---|---|---|
| 289,495 | 12/1883 | Bennor | 4/434 |
| 5,101,519 | 4/1992 | Yamamoto | 4/547 X |

FOREIGN PATENT DOCUMENTS

| | | | |
|---|---|---|---|
| 50-22634 | 3/1975 | Japan . | |
| 53-67937 | 6/1978 | Japan . | |
| 59-24479 | 2/1984 | Japan . | |
| 4-210059 | 7/1992 | Japan . | |
| 3019077 | 9/1995 | Japan . | |
| 3034357 | 11/1996 | Japan . | |
| 23540 | 10/1910 | United Kingdom | 4/434 |

*Primary Examiner*—Robert M. Fetsuga
*Attorney, Agent, or Firm*—Rader, Fishman & Grauer

[57] ABSTRACT

The invention provides; a flush toilet having an odor-sealing valve which can certainly be opened and closed with a simple structure and enables easy maintenance, capable of preventing waste matter adhering on it from facing toward the toilet bowl, and effectively working when a patient unintentionally defecates; a care bed apparatus which reduces physical work load on a nurser when bathing the patient; and others. A water tank 52 is provided below a toilet bowl 51, and an odor-sealing valve 57 is made of a sphere 57*a* floating in the water tank 52 and a ring-shaped packing 57*b* located near a lower opening 51*a* of the toilet bowl 51 and capable of coming in close contact with said sphere 57*a*. Drainpipes and drain valves 66*a*, 67*a*, 66*b*, 67*b* lower the water level in the water tank 52 to open the odor-sealing valve 57 and a water-supply pipe 64*a* and a water-supply valve 64*b* raise the water level in the water tank 52 to close the odor-sealing valve 57. The odor is evacuated as shown by the arrows Fa and cleaning water flows down onto the sphere 57*a* as shown by the arrows Fw to clean away waste matter S and to turn the sphere.

10 Claims, 13 Drawing Sheets

WATER CLOSET AND NURSING BED DEVICE WITH SAME

TECHNICAL FIELD

The present invention relates to a flush toilet having a toilet bowl, a drainage, and an odor-sealing valve for shutting off the toilet bowl from the drainage, and a care bed apparatus having this flush toilet.

BACKGROUND ART

Usually, in the field of flush toilets, a drain trap formed of S-shaped pipe is provided between the toilet and the drainpipe, in which sealing water prevents reverse flow of offensive odors from the drainpipe. When sewage water is drained through a drain trap having this structure, however, sewage water must be speeded by utilizing the pipe head, which causes the problems that the total vertical length of the drainpipe must be long and that it is often clogged up with waste matter.

To solve such disadvantages of drain traps, Japanese Patent Publication No.50-11188 and Japanese Patent Laying-Open No.53-98137 disclose flush toilets, and Japanese Patent Laying Open No.3-186265 discloses a care bed. The inventions of the first and third references suggest structures of odor-sealing valves in which a rubber tube etc. provided in a drainpipe is filled with air from an air pump etc. to close the drain hole and is evacuated to open the drain hole. The invention of the second reference suggests an odor-sealing valve in which a hole is opened/closed with a hemispherical member turned by a foot pedal.

However, according to the inventions of the first and third references, parts like the air pump and air piping complicate the structure, and the use of a rubber tube susceptible to deterioration in a moving part requires difficult process for fabricating the odor-sealing valve and its vicinity and troublesome maintenance. Also, the invention of the second reference encounters the same problems because of the presence of a mechanism for opening/closing the hole. Further, in any of the background arts, when excrement adheres to the upper part of an odor-sealing valve, this surface attaches on the toilet bowl side, which causes unpleasant feeling.

With the conventional care bed according to the third reference, odors in defecation are not sufficiently prevented from spreading. Further, according to the conventional care bed of the third reference, it is necessary to previously, before defecation, evacuate the rubber tube located in the position of buttocks to open the toilet seat, and therefore it does not work when a patient unintentionally defecates. Further, with the conventional care bed, it is necessary, when bathing a patient, to remove the patient from the bed to another place, which heavily burdens the nursers.

Considering the problems of the background arts, an object of the present invention is to provide a flush toilet having an odor-sealing valve which can be certainly opened/closed with a simple structure and enables easy maintenance.

Another object of the present invention is to provide a flush toilet which does not allow adhering waste matter to face toward the bowl of the toilet.

Still another object of the present invention is to provide a flush toilet which can effectively work when a patient etc. unintentionally defecates.

An object of a care bed apparatus of the present invention is to reduce physical burden on nurses when bathing a patient, as well as enabling the above-mentioned rational means for dealing with defecation.

DISCLOSURE OF INVENTION

The present invention is directed to a flush toilet having a toilet bowl, a drainage part, and an odor-sealing valve for shutting off the drainage part from the toilet bowl; the flush toilet comprising: a water tank provided below said toilet bowl, said odor-sealing valve comprising a spherical body floating in the water tank and a ring-shaped packing located near a lower opening of the toilet bowl and capable of coming into close contact with said spherical body; drainage control means capable of lowering water level in said water tank to open said odor-sealing valve; and water-supply control means capable of raising the water level in said water tank to close said odor-sealing valve.

For example, the "drainage control means" comprises "a drainpipe and a valve connected to a middle part in the height direction of said water tank," the "water-supply control means" comprises "a water-supply pipe, a water-supply valve, and a water-level sensor," and the "drainage part" comprises a drainpipe. According to the feature, the odor-sealing valve can be opened by buoyancy of the spherical body floating in the water tank when the water-level in the water tank is kept high by the water-supply control means. When the drainage control means lowers the water level in the water tank, the spherical body is displaced downward and the odor-sealing valve can thus be opened.

To achieve another object above, another feature of the present invention comprises, in addition to the above-mentioned feature, water-supply means for downwardly flushing cleaning water from above said toilet bowl, wherein, when said odor-sealing valve is opened, the cleaning water falls onto said spherical body through the lower opening of said toilet bowl.

Usually, when waste matter adheres on the surface of the spherical body, that part turns downward due to the balance of gravity, since said spherical body is floating on water. According to this feature, cleaning water falls down onto the spherical body through the lower opening of the toilet bowl, and then the cleaning water hits the waste mater adhering on the surface of the spherical body and cleans away the waste matter, and it also turns the spherical body so that the part on which waste matter adheres is located on the under side of the spherical body.

Preferably, said spherical body and said packing come to abut on each other before the water level reaches the lower opening of the toilet bowl. According to this feature, when, very rarely, waste matter having smaller specific gravity than water attaches, that part is located below the packing. When the water level is lower than the lower opening of the toilet bowl after the water supply has been finished, the upper surface inside the toilet bowl can be kept dry.

To achieve the above-mentioned still another object of the present invention, still another feature of the present invention comprises, in addition to the above feature, an air passage unit provided above or over the toilet bowl, for blowing hot air in normal state and evacuating odor during defecation. According to this feature, when a bedridden patient unable to control defecation by oneself is lying with his/her buttocks and abdominal region exposed toward the toilet bowl, for example, hot air warms up the buttock region so that the patient can stay comfortable. During defecation, the odor is evacuated so that offensive smell will not spread around, so as to prevent unpleasant feeling due to bad smell.

In addition, preferably, the flush toilet further comprises a sensor provided above or over the toilet bowl, for sensing waste matter falling, wherein when the sensor senses falling waste matter, said drainage control means opens said odor-sealing valve, said water-supply means flushes the cleaning water, and said air passage unit evacuates odor. According to this feature, even if a bedridden patient unintentionally defecates, the processes for cleaning away waste matter and evacuating the odor are automatically performed. These features are useful not only in a care bed but also as a flush toilet used in an air plane etc.

In an embodiment of the present invention, said drainage control means comprises a first drainpipe and a first valve connected to a middle part in the height direction of said water tank, and a second drainpipe and a second valve connected to the bottom of said water tank, wherein the second valve is opened after the first valve is opened. According to this structure, the first valve is opened to open the odor-sealing valve, which allows the spherical body to float on water and freely turn. Subsequently, the second valve is opened to drain the water containing waste matter all together to clean up the inside of the water tank.

In this invention, it is preferable to use, as the above-mentioned sensor, an optical sensor which senses waste matter falling in the toilet when an optical path from a light-emitting part to a light-receiving part is intercepted. Further, an air passage unit for at least blowing hot air from one direction toward buttocks of a user and a cleaning device for cleaning said buttocks are arranged above or over the toilet bowl, in a direction intersecting said optical path at a level approximately equal to the level of said sensor, which allows reduction of the entire height of the toilet.

To achieve the above object of a care bed apparatus of the present invention, according to a feature of the present invention, a care bed apparatus comprises a care bed having said flush toilet, a bathtub located under the care bed, and moving means for laterally moving said care bed. According to this feature, locating the bathtub under the care bed saves space for the bathtub and reduces the distance in which a patient is moved. Particularly, when it is further equipped with a lift for lifting up or down the patient, the bed can be laterally moved while the patient is lifted up and down by the lift so that the patient can be moved to the bath with reduced labor.

As have been described above, according to the feature of the flush toilet of the present invention, the odor-sealing valve can certainly be opened and closed with a simple structure for raising and lowering the spherical body by controlling the water level, and it can certainly be opened and closed as long as the spherical body and the packing of the odor-sealing valve can certainly be kept in close contact, which allows easy maintenance.

Further, according to the above-mentioned another feature of the present invention, the falling water and the balance of the spherical body floating on water can be utilized to prevent waste matter adhering to the spherical body from facing toward the toilet bowl, which avoids the unpleasant trouble that the toilet looks offensive after defecation.

Moreover, according to the above-mentioned still another feature of the present invention, hot air is always blown so that the patient can always expose the abdominal region, and then it is possible to deal with defecation without allowing odor to spread even when the patient unintentionally defecates.

According to the feature of the care bed apparatus of the present invention, since the bed can be laterally moved, the bath can be installed in a smaller space and the patient can be moved to and bathed in the bath by reduced labor. This reduces physical work load on nursers who nurse a patient like a bedridden old person and remarkably improves sanitation and comfortableness of the patient.

Details of the present invention will become more apparent from the following detailed description of the most preferred embodiments for implementing the invention. The reference characters in claims are attached just for convenience to clearly show the correspondence with the drawings, which are not intended to limit the present invention to the configurations shown in the accompanying drawings.

BEST MODE FOR CARRING OUT INVENTION

Figure 1:
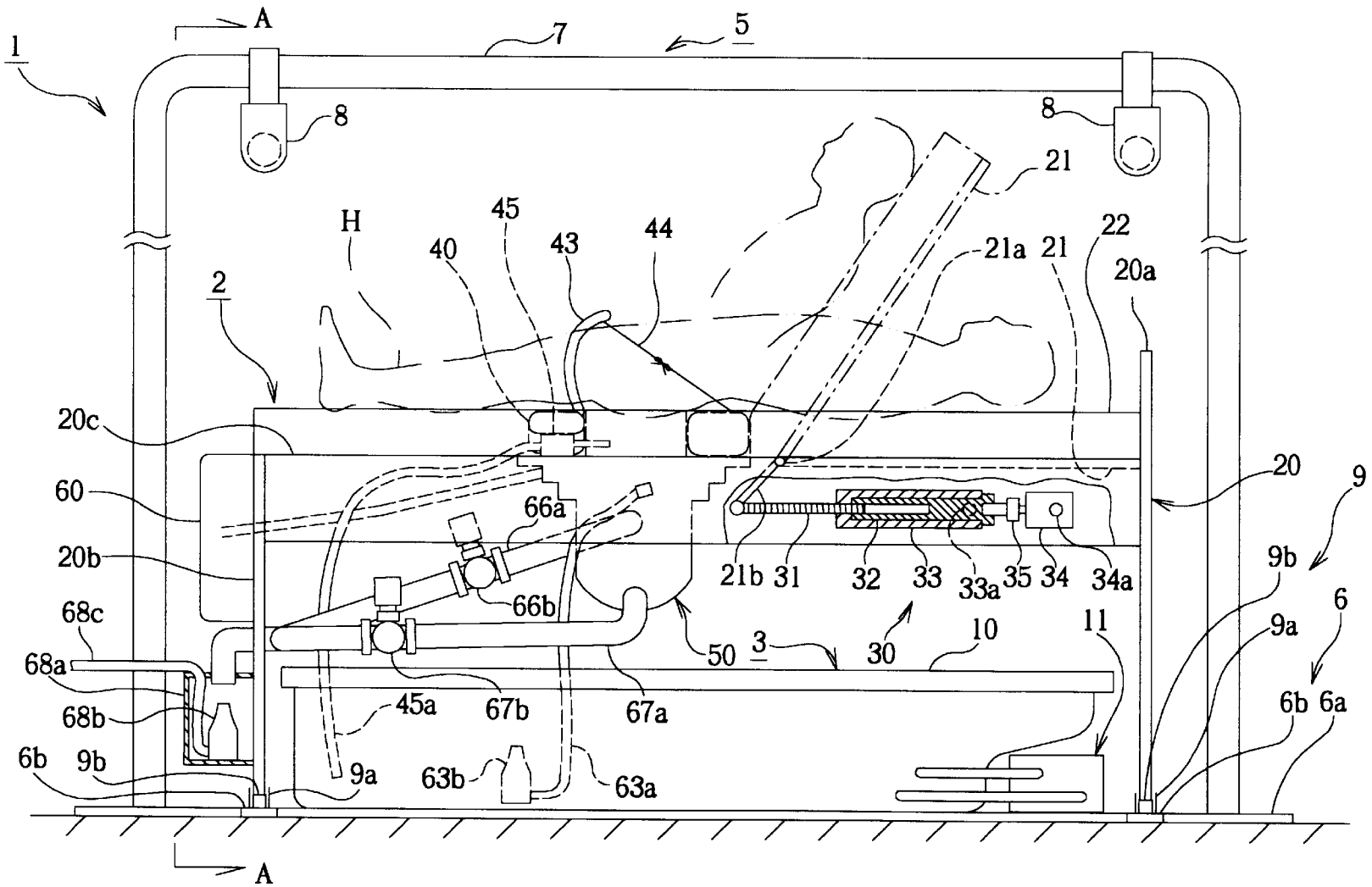
FIG. 1 is a partially cutaway side view of a care bed apparatus according to the present invention.

Next, an embodiment of the present invention will be described referring to the drawings.

Figure 2:
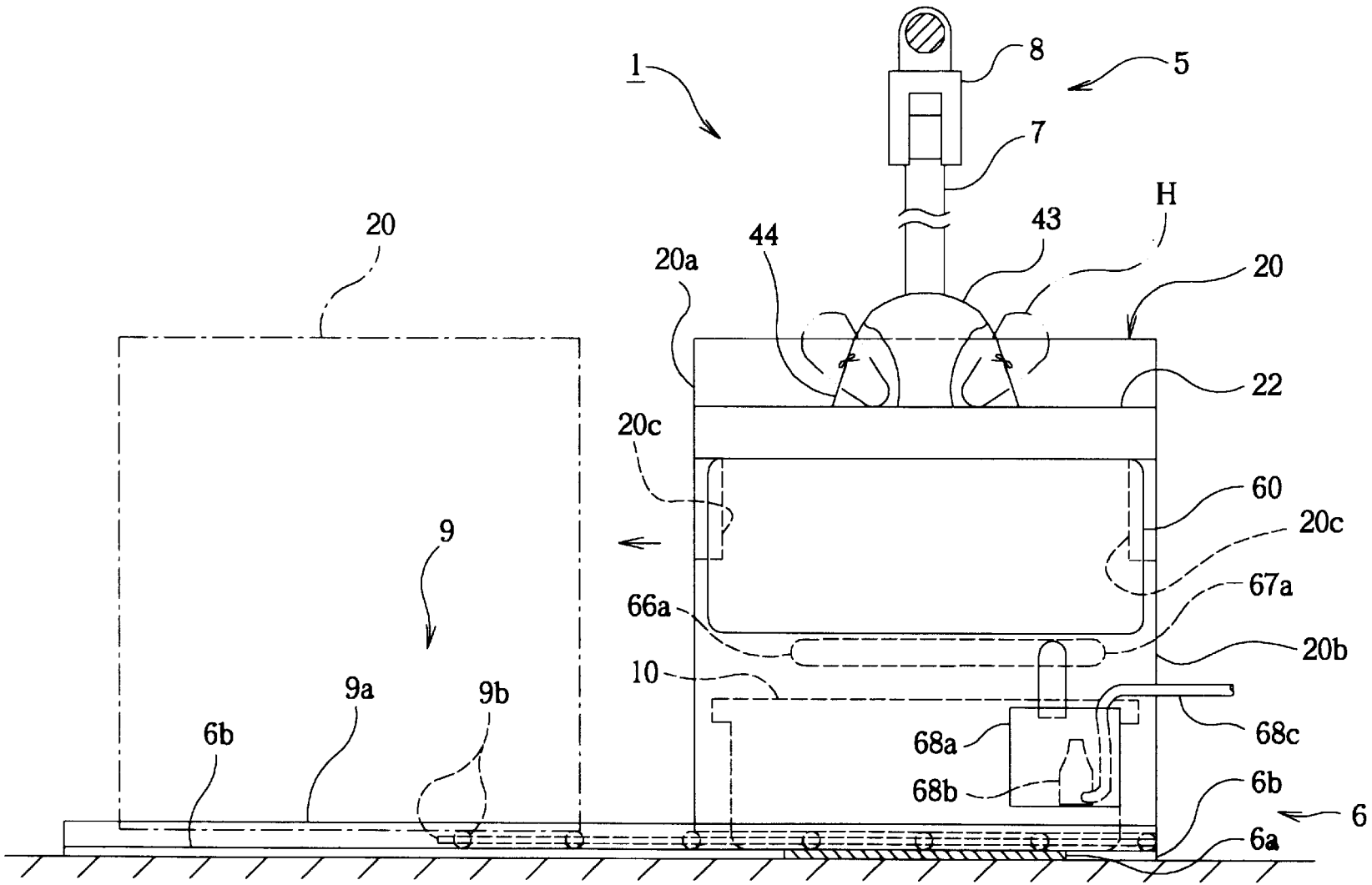
FIG. 2 is the sectional view taken along the ling A—A in FIG. 1.

As shown in FIG. 1 and FIG. 2, a care bed apparatus 1 of the present invention includes a care bed 2, a bath 3, and a lift 5 for moving a patient etc. H lying on the care bed 2 to the bath 3 by lifting up and down. As shown in FIG. 1 and FIG. 2, the bathtub 10 of the bath 3 is laid on a longitudinal frame 6*a* having a width close to the width of the bottom of the bathtub 10 in an anchor frame 6. As shown in FIG. 2, lateral frames 6*b*, 6*b* project from two parts on the lengthwise sides of the longitudinal frame 6*a* on right side, and especially on left side, of the longitudinal frame 6*a*. A support frame 7, U-shaped as seen from a side, is affixed at its two lower ends on the longitudinal frame 6*a* in the anchor frame 6, and the two lateral frames 6*b* and the weight of water in the bathtub 10 prevent the lift 5 from collapsing.

The above-described care bed 2 has the body of bed, 20, and moving means 9 for laterally moving the body 20 of the bed along the lateral frames 6*b*. The body 20 of the bed basically includes a head plate 20*a* and a foot plate 20*b* arranged in the head-to-foot direction and coupled on their right and left sides through a pair of side plates 20*c*, 20*c*, and a lattice 21, partially shown in FIG. 1, and a mat 22 laid thereon. The lattice 21 slantingly raises up the upper part of the mat 22 with a raising mechanism 30. A toilet 50 and a toilet seat 40 are provided in the center area of the body 20 of the bed such that the opening of the toilet 50 is located under the buttocks of the lying patient H. An operating unit 60 for controlling valves and motors in the piping system described later is attached in an upper part of the side plates 20*c*, and a drain tank 68*a* etc. are attached below it.

The above-described moving means 9 includes rails 9*a*, shaped like a channel in section, provided on the pair of lateral frames 6*b*, 6*b*, and rolling rails 9*b* provided inside the channel-shaped rails 9*a*: The legs of the head plate 20*a* and the foot plate 20*b* of the body 20 of the bed are fitted on the rolling rails 9*b*, 9*b*. Each rolling rail 9*b* is comprised of a plurality of rollers coupled by a frame, which can move the entirety of the body 20 of the bed to right and left as the rollers of the rolling rails 9*b* roll. The depth of the channel-shaped rails 9*a* is deeper than the diameter of the rolling rails 9*b* to prevent the legs of the head plate 20*a* and foot plate 20*b* from coming off. The moving means 9 is utilized to move the body 20 of the bed from right to left in FIG. 2 when the bathtub 10 is used.

Figure 8:
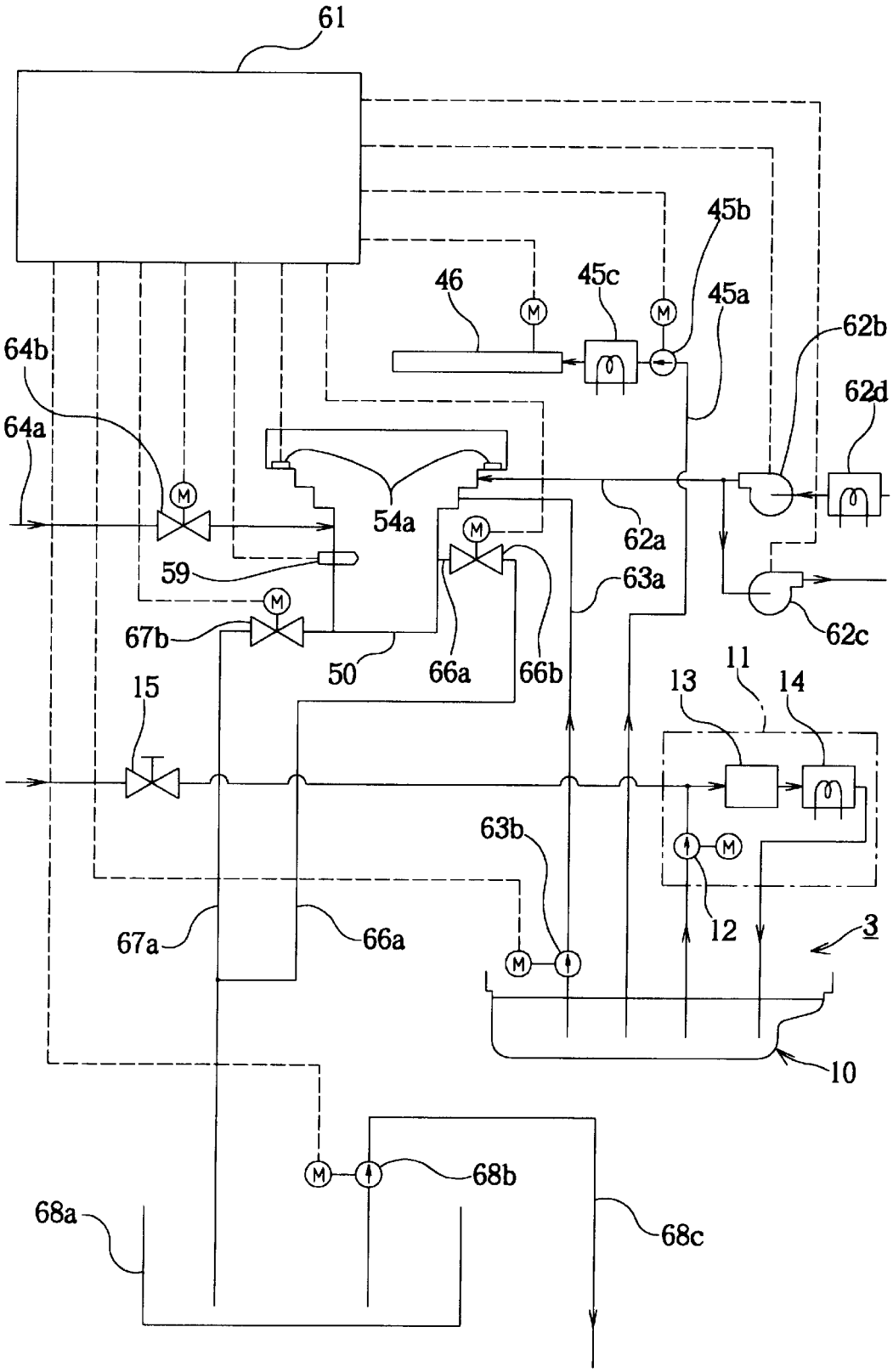
FIG. 8 is a diagram showing the entire piping system of the care bed apparatus.

The above-described bath 3 has the stainless bathtub 10 and a purifier 11 shown in FIG. 8 for purifying water in the bathtub 10 by circulation and keeping the water at constant temperature. The part of the bathtub 10 corresponding to the head of the patient is upwardly bent to accommodate the purifier 11. Under the body 20 of the bed which is laterally moved by the moving means 9, piping 67*a* and other parts stay at a level high enough to avoid interference with the top of the bathtub 10, since these parts have reduced vertical dimensions due to the structure described later. The purifier 11 has a pump 12 for pumping up water in the bathtub 10, a filter unit 13 for removing impurities, ammonia, etc. from the bath water pumped up by the pump 12, and a heater 14 for keeping the bath water at constant temperature. The filter unit 13 is so constructed that tap water can be supplied from outside through a manually-operated water-supply valve 15.

The lift 5 has the support frame 7 attached on the anchor frame 6 and a pair of electric pulleys 8, 8 attached on the horizontal part of the support frame 7. Each of the electric pulleys 8 can be slid to the middle part of the support frame 7 when used, which are usually located at the vertical ends of the horizontal part so as not to bother the patient H lying on the body 20 of the bed.

As shown in FIG. 1, the raising mechanism 30 has a male screw shaft 31 and a female screw shaft 32 accommodated in a tube-like sleeve 33, which mate each other as the female screw shaft 32 is turned through a driving motor 34 and a universal coupling 35. The sleeve 33 and the motor 34 are pivotally supported across the body 20 of the bed by a pivotal sleeve shaft 33*a* and a pivotal motor shaft 34*a*, respectively. The upper part of the lattice 21 is pivotally supported on the body 20 of the bed by a pivotal lattice shaft 21*a*, with an arm 21*b* extending under the lattice 21 and coupled to the end of the male screw shaft 31. The motor 34 drives the female screw shaft 32 to turn it relatively to the male screw shaft 31 to move the end of the male screw shaft 31 closer to the pivotal sleeve shaft 33*a*, so as to slantingly raise up the body 20 of the bed together with the mat 22 through the arm 21*b*, which allows the patient H to comfortably defecate with his/her back leaning against it, as shown by the chain lines in FIG. 1.

Figure 3:
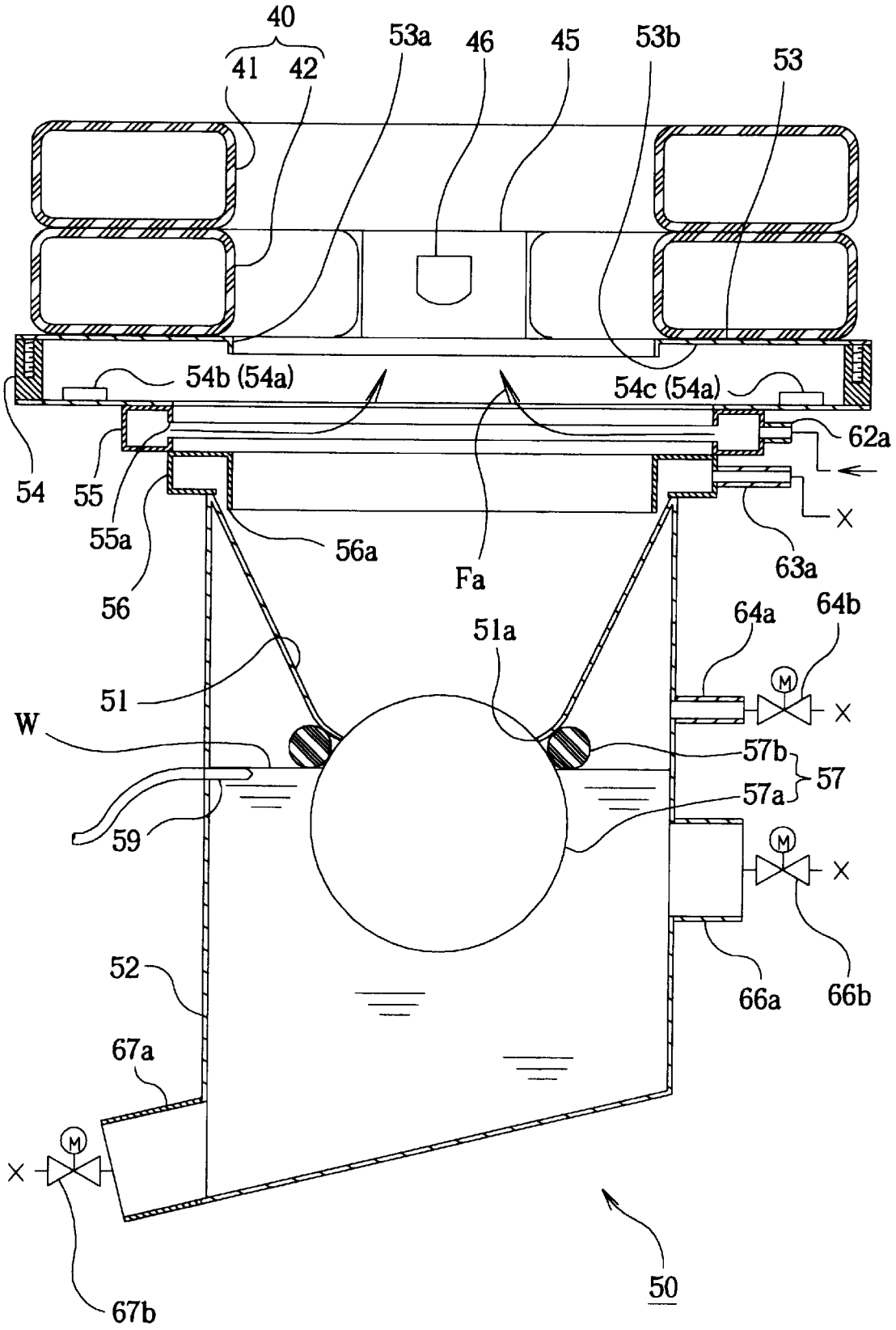
FIG. 3 is a longitudinal sectional view showing a structure of a flush toilet.

The toilet seat 40 fitted in a hollow part in the center of the mat 22 is formed of a pair of upper and lower seats 41 and 42 made of tubes of rubber or synthetic resin, which can be filled out with air, as shown in FIG. 3. While the upper seat 41 is formed in a ring shape, the lower seat 42 is shaped like a horseshoe; a cleaner 45 for cleaning buttock region is accommodated in the hollow part surrounded by the lower surface of the upper seat 41 and the cut sides of the lower seat 42. A cover 43 of rubber or synthetic resin projects from the upper part of the toilet seat 40 to cover the excretory region of the patient H; strings 44, 44 attached to two parts near the upper edge of the cover 43 are tied to strings extending from the toilet seat 40 from the head side to the foot side or to handrails of the bed not shown, and thus the cover 43 covers the excretory region of the patient H.

The piping system of the care bed apparatus 1 will be described referring to FIGS. 1 to 3 and 8. The valves and motors in the piping system are controlled by a controller 61 accommodated in the above-described operating unit 60. As will be described later, air is passed in an air passage 55 through an air pipe 62*a*, where hot air is sent by an air-sending blower 62*b* and an air heater 62*d*. Air is evacuated through the air passage 55 via the air pipe 62*a* and an air-evacuating blower 62*c*. In defecation, cleaning water is supplied from the water in the bathtub 10 through a first water-supply pipe 63*a* and a first water-supply pump 63*b*. Further, water is supplied to force up the water level in the water tank 52 to close the odor-sealing valve 57 through a second water-supply pipe 64*a* connected to clean water and a water-supply valve 64*b* constructed as an electromagnetic valve.

Drainage control means for lowering the water level in the water tank 52 of the toilet 50 is comprised of first and second drainpipes 66*a*, 67*a*, and first and second drain valves 66*b*, 67*b*. The waste water is received in the drain tank 68*a* and then is discharged out by the drain pump 68*b* through a third drainpipe 68*c*. Solid wastes in the drain tank 68*a* are crushed by rotation of an impeller of the drain pump 68*b* and discharged to the outside.

The cleaner 45 has a water-supply tube 45*a* and a second water-supply pump 45*b* for pumping up water in the bathtub 10 and a hot-water heater 45*c* for appropriately raising the temperature of the bath water. The pumped-up and temperature-adjusted bath water is emitted toward the excretory region of the patient H from the end of an expandable cleaning nozzle 46 to wash the excretory region of the patient H. The water-supply tube 45*a* may be connected to clean water, like tap water, similarly to the second water-supply pipe 64*a*.

As shown in FIG. 3 and FIG. 8, the toilet 50 has the cone-shaped toilet bowl 51, the approximately cylindrical water tank 52 surrounding the bowl, the ring-shaped sensor frame 54, the air passage 55, and the ring-shaped water-supply frame 56 provided above the water tank 52, and an odor-sealing valve 57 for blocking up the lower opening of the toilet bowl 51. These ring-shaped sensor frame, air passage, and ring-shaped water-supply frame, 54 to 56, are formed by welding a curved elongate stainless plate to ring-shaped upper and lower stainless plates, with hollow inside.

Figure 7:
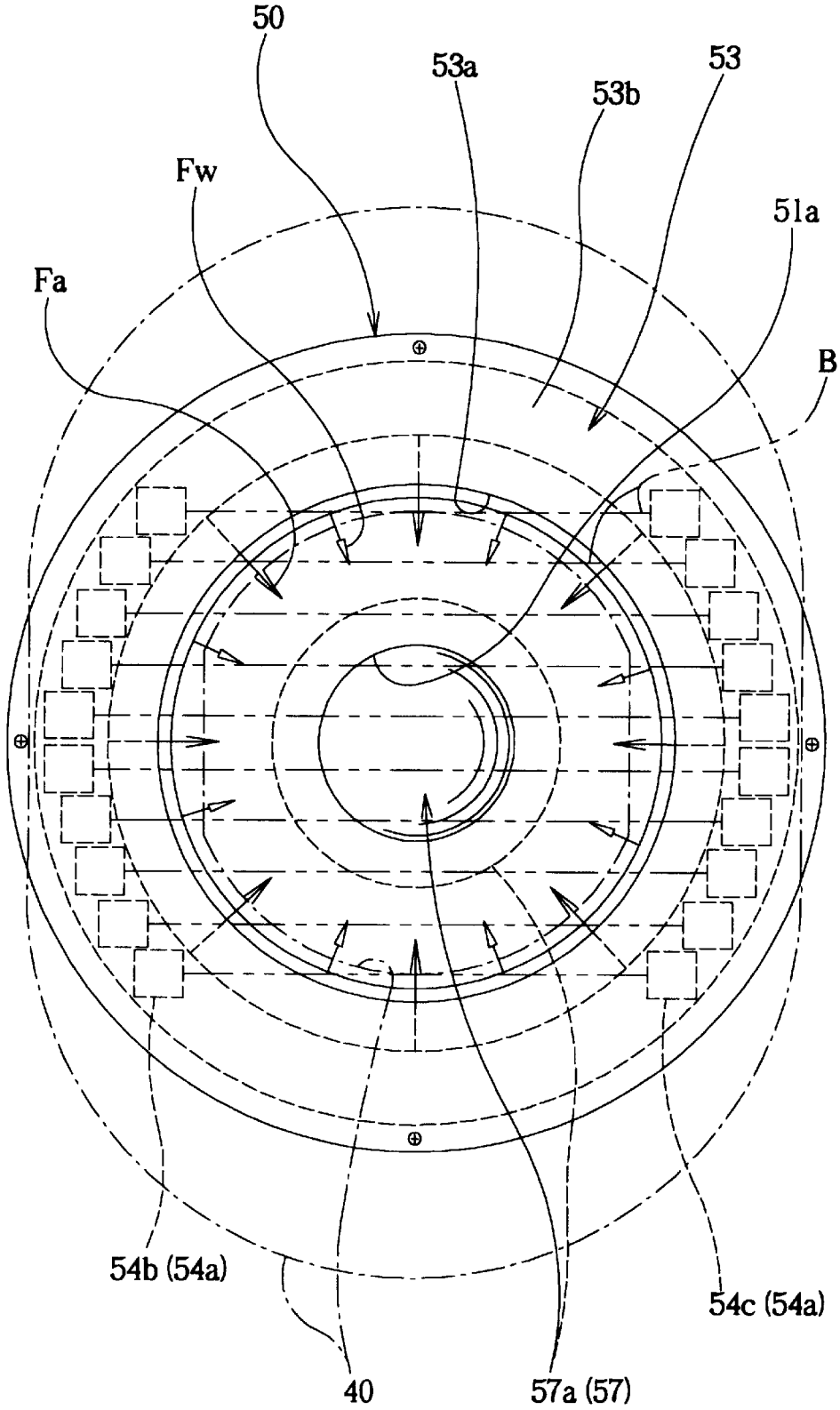
FIG. 7 is a plane view showing the flush toilet.

The upper surface of the uppermost ring-shaped sensor frame 54 forms a rest 53 on which the toilet seat 40 is rested. This rest 53 is formed by detachably affixing a ring-shaped rest plate 53*b* having an upper opening 53*a* with flush screws. Provided inside the ring-shaped sensor frame 54 is a falling matter sensor 54*a*, or an optical sensor having light-emitting parts 54*b* and light-receiving parts 54*c,* as shown in FIG. 7. A plurality of light-emitting parts 54*b* and light-receiving parts 54*c* are oppositely arranged on right and left sides across the upper opening 53*a,* with optical paths B extending across the opening of the toilet 50 from the light-emitting parts 54*b* to the light-receiving parts 54*c*. With the falling matter sensor 54*a,* even a drop of wastes falling through the upper opening 53*a* toward the toilet bowl 51 intercepts some light passing between the oppositely arranged light-emitting parts 54*b* and light-receiving parts 54*c,* which functions as a trigger for starting supply of clean water and exhaust of air described later.

The air passage 55 has a plurality of through holes 55*a* on its inner side. Hot air supplied through the air pipe 62*a* is blown toward the center as shown by the arrows Fa, and air is evacuated to remove the odor through the through holes 55*a* at the time of defecation.

For the ring-shaped water-supply frame 56 on the bottom, the plate vertically located on the inner side somewhat juts out downward to form a slit 56*a* with the lower ring-shaped plate. In this structure, hot water supplied through the first water-supply pipe 63*a* is poured from the slit 56*a* and flows along the cone-shaped surface of the toilet bowl 51 as cleaning water.

Figure 6:
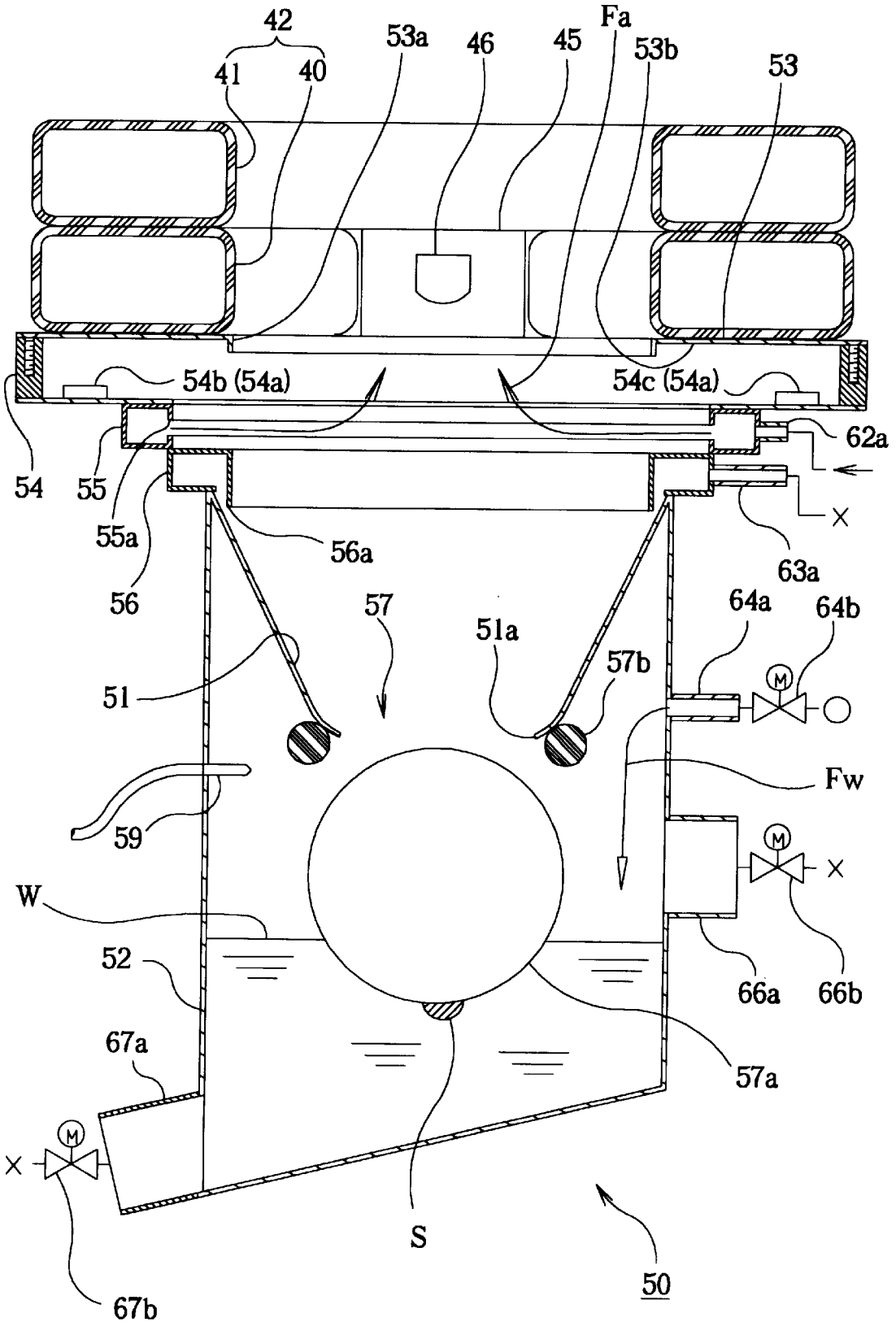
FIG. 6 is a diagram showing the structure in which first and second drain valves are closed and a second water-supply pipe is supplying water, which corresponds to FIG. 3.

A ring-shaped rubber packing 57*b* is attached on the outer surface of the toilet bowl 51 near the lower opening 51*a*. Further, a spherical stainless hollow ball 57*a* serving as the odor-sealing valve 57 with the packing 57*b* is floated in contact with the packing 57*b* on the water W in the water tank 52. This ball 57*a* has its outer diameter smaller than the inner diameter of the packing 57*b,* and it is constructed, as shown in FIG. 6, so that about two-thirds of the body is exposed above the surface of the water W when it is separated from the packing 57*b*. The water-level sensor 59 is a non-contact water-level sensor utilizing optical fiber, which is attached at such a position that water supply from the second water-supply pipe 64*a* is stopped about when the water W reaches the lower part of the packing 57*b*.

Figure 9:
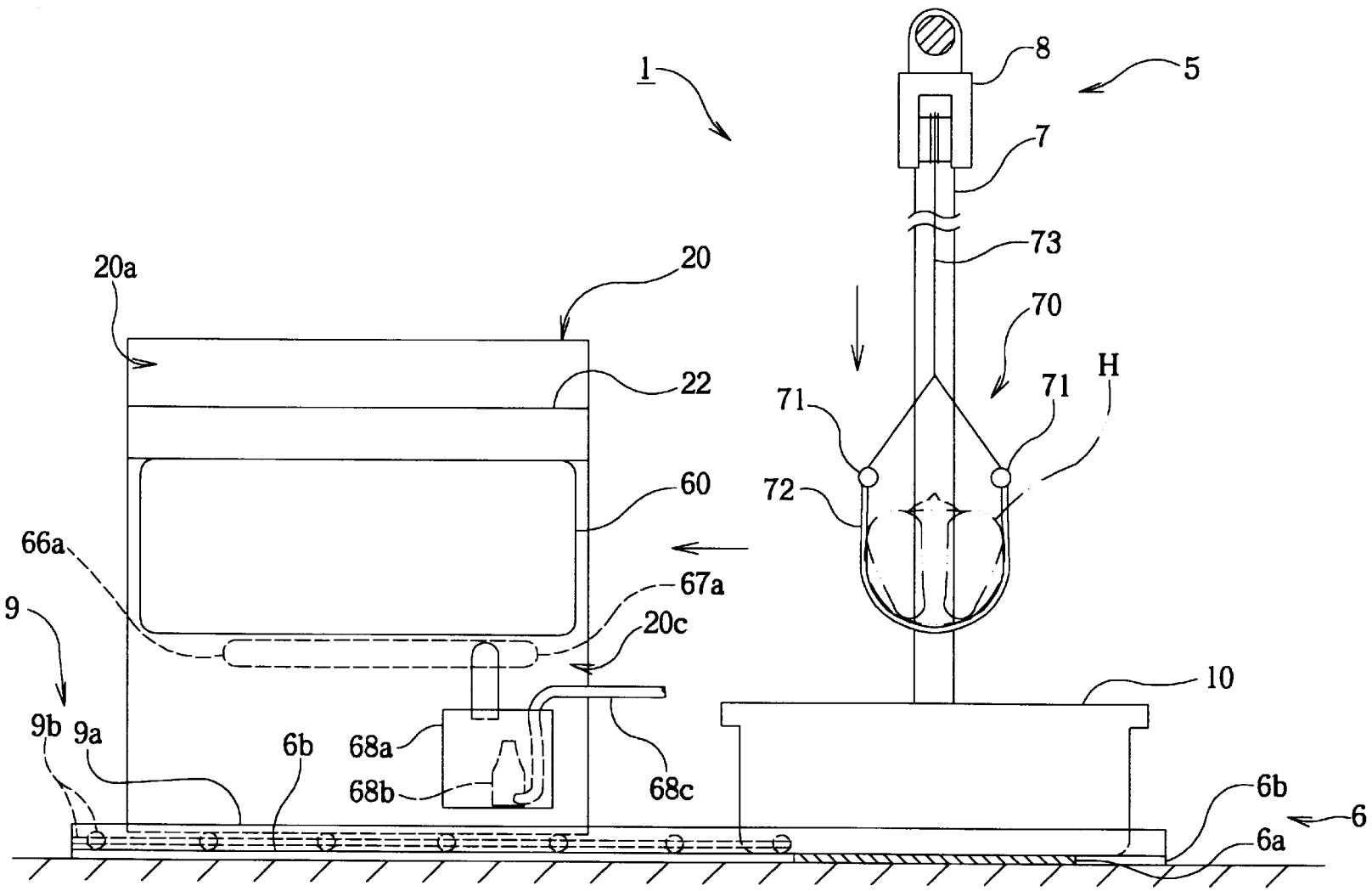
FIG. 9 is a diagram showing the process of moving a patient to the bath by using a lift, which corresponds to FIG. 2.

Now referring to FIG. 9, a cot 70 for bringing up and down the patient H by utilizing the lift 5 will be described. This cot 70 is formed of a pair of right and left support bars 71, 71, a net 72 suspended across the bars, and a pair of hanging cords 73 for coupling the support bars 71, 71, which are wound up by the electric pulleys 8. When moving the patient H to the bathtub 10, the patient H on the bed is first moved onto the net 72 and then lifted up on the cot 70 by rotatively driving the electric pulleys 8. Subsequently, as shown in FIG. 9, the body 20 of the bed is moved by the moving means 9 to the left direction in this diagram and the hanging codes 73 are extended to move the patient H into the bathtub 10. After bathing, the patient is returned onto the bed by reverse procedure.

Next, referring to FIGS. 3 to 6, the control procedure by the controller 61 shown in FIG. 8 will be described.

First, in the normal condition shown in FIG. 3, hot air is being blown out from the vent holes 55*a,* with the water-supply valve 64*b,* first drain valve 66*b,* and second drain valve 67*b* all closed. The ball 57*a* is abutting against the packing 57*b* with its upper part exposed above the water surface by buoyancy, and the odor-sealing valve 57 is thus being closed.

Figure 4:
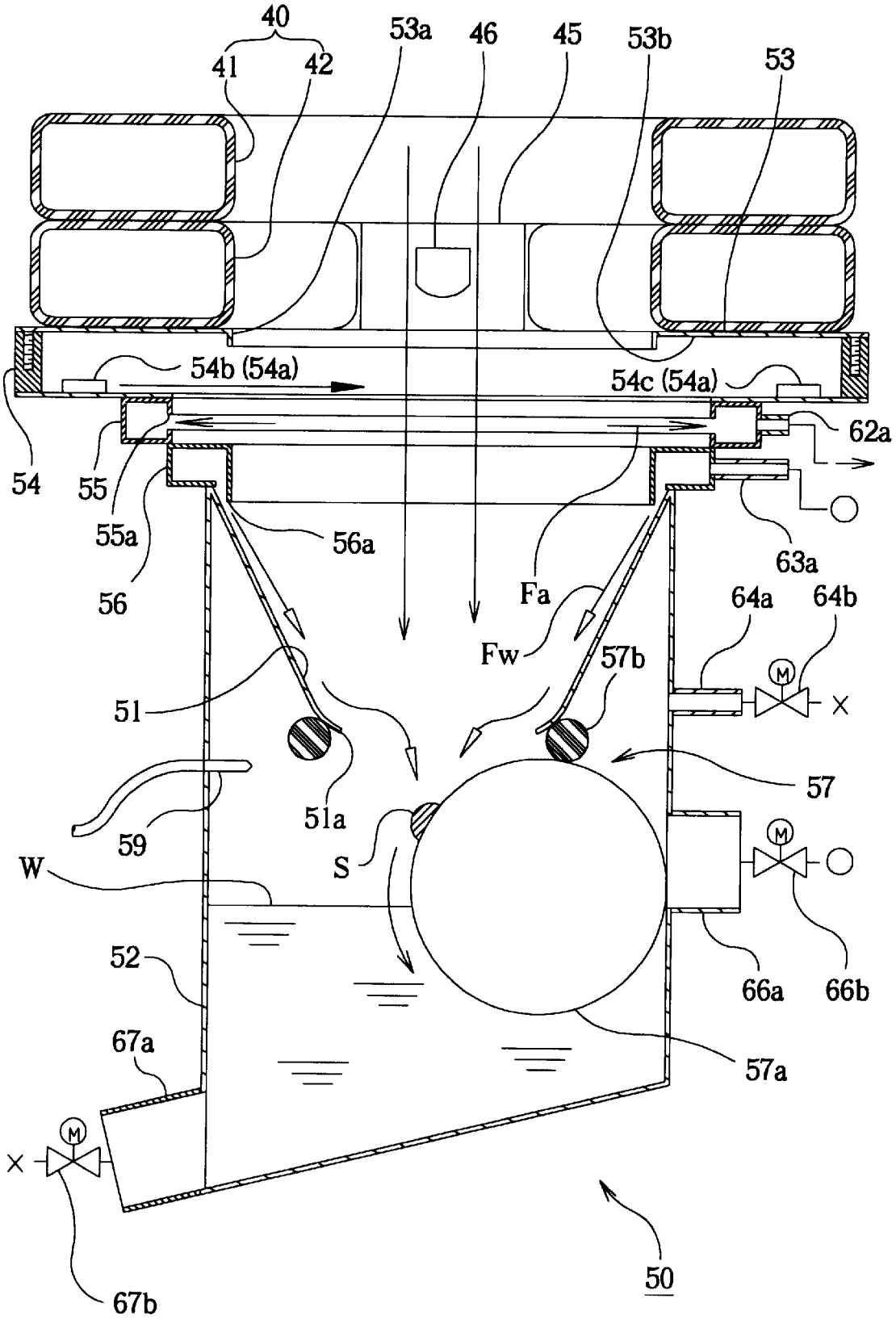
FIG. 4 is a diagram showing the structure with an odor-sealing valve opened, which corresponds to FIG. 3.

Next, as shown in FIG. 4, when even a drop of waste matter like urine or feces falls into the toilet bowl 51, it intercepts at least part of the lights from the plurality of light-emitting parts 54*b* to the light-receiving parts 54*c* as described above, which starts control to the device according to the control procedure described below.

First, the first drain valve 66*b* is opened and the water W descends to the lower end of the opening of the first drainpipe 66*a,* and the ball 57*a* and the packing 57*b* are thus separated away to open the odor-sealing valve 57. At the same time, hot air from the vent holes 55*a* is stopped and the odor of the excrements is vacuumed through the vent holes 55*a,* air pipe 62*a* and air-evacuating blower 62*c*. Although not shown in the drawing, the upper part of the bed is raised by the above-described raising mechanism 30. Further, the first water-supply pump 63*b* is driven to cause cleaning water to flow as shown by the arrows Fw along the entirety of the cone-shaped surface of the toilet bowl 51 through the first water-supply pipe 63*a* and the cleaning water slit 56*a*. The cleaning water rapidly falls onto the ball 57*a* floating on the water W through the lower opening 51*a* of the toilet bowl 51, so that even a patch of waste matter adhering to the ball 57*a* is cleaned away by the cleaning water. Further, the cleaning water impacts against the adhering waste matter with force to turn the entirety of the ball 57*a,* and then the part on which waste matter is adhering is located on the under side. Setting the inner diameter of the water tank 52 smaller than twice of the diameter of the ball 57*a* enables the falling water to hit the ball 57*a*.

Figure 5:
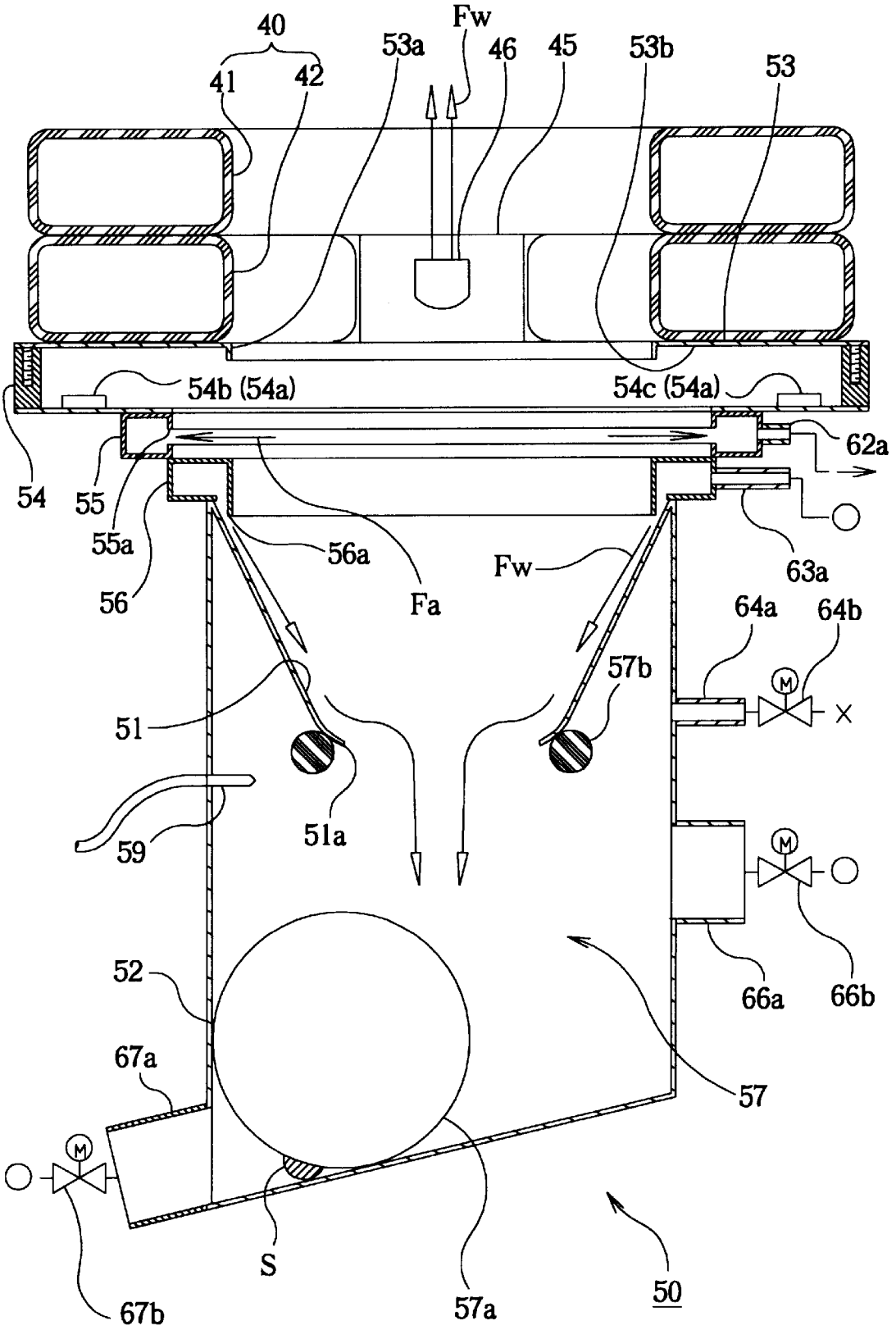
FIG. 5 is a diagram showing the structure with the water in the water tank having been completely exhausted, which corresponds to FIG. 3.

FIG. 5 shows the state after a given time period set in a timer in the controller 61 passed after defecation was sensed by the sensor 54*a* as shown in FIG. 4. The given time set by the timer is about three minutes, which can be appropriately set, depending on the patient, preferably to an estimated time between the detection at the beginning and the end of the defecation. In this state, cleaning water is continuously flowing from the cleaning water slit 56*a* and odor is also being vacuumed continuously through the vent holes 55*a,* and the second drain valve 67*b* is opened to drain out all of the water in the water tank 52 through the second drainpipe 67*a*. After an appropriate time interval, the cleaning nozzle 46 extends from the cleaner 45 toward the excretory region of the patient H and emits cleaning water upward in a given time period to wash the excretory region.

After cleaning the excretory region, the cleaning nozzle 46 shrinks in a horizontal direction, the first drain valve 66*b* and the second drain valve 67*b* are both closed, and the water-supply valve 64*b* is opened to pour external tap water into the water tank 52 through the second water-supply pipe 64*a,* and then the water level of the water W gradually goes up. In this state, no cleaning water is being supplied from the cleaning water slit 56*a,* and the vent holes 55*a* start blowing hot air. Then, at the time when the water level is sensed by the water-level sensor 59, the water-supply valve 64*b* is closed to return to the initial state shown in FIG. 3. Since the second water-supply pipe 64*a* as water-supply control means is provided separately from the first water-supply pipe 63*a,* the pressure for pressing the ball 57*a* against the packing 57*b* can be increased even after the odor-sealing valve 57 has been closed. After the series of operations, the raising mechanism 30 is reversely operated to return the upper part of the bed to the flat attitude.

When even a small amount of waste matter adheres to the surface of the ball 57*a,* the part on which the waste matter adheres is located in the water due to the balance of gravity of the floating ball 57*a* and the flowing water from the lower end of the toilet bowl 51*a*. Even if feces having specific gravity lighter than that of water adhere to the ball 57*a,* that part is always located below the packing 57*b*. Accordingly, a cleaned part of the curved surface of the ball 57*a* is always exposed upward to the toilet bowl 57 through the lower opening 51*a* as the exposed upper surface of the ball 57*a*. The waste matter adhering to the ball 57*a* is soaked in the water W with the odor-sealing valve 57 closed to prevent the escape of odor, and it sufficiently absorbs water to become soft, which will be easily cleaned away when cleaned in the next time.

Next, another possible embodiment of the present invention will be described.

Figure 10:
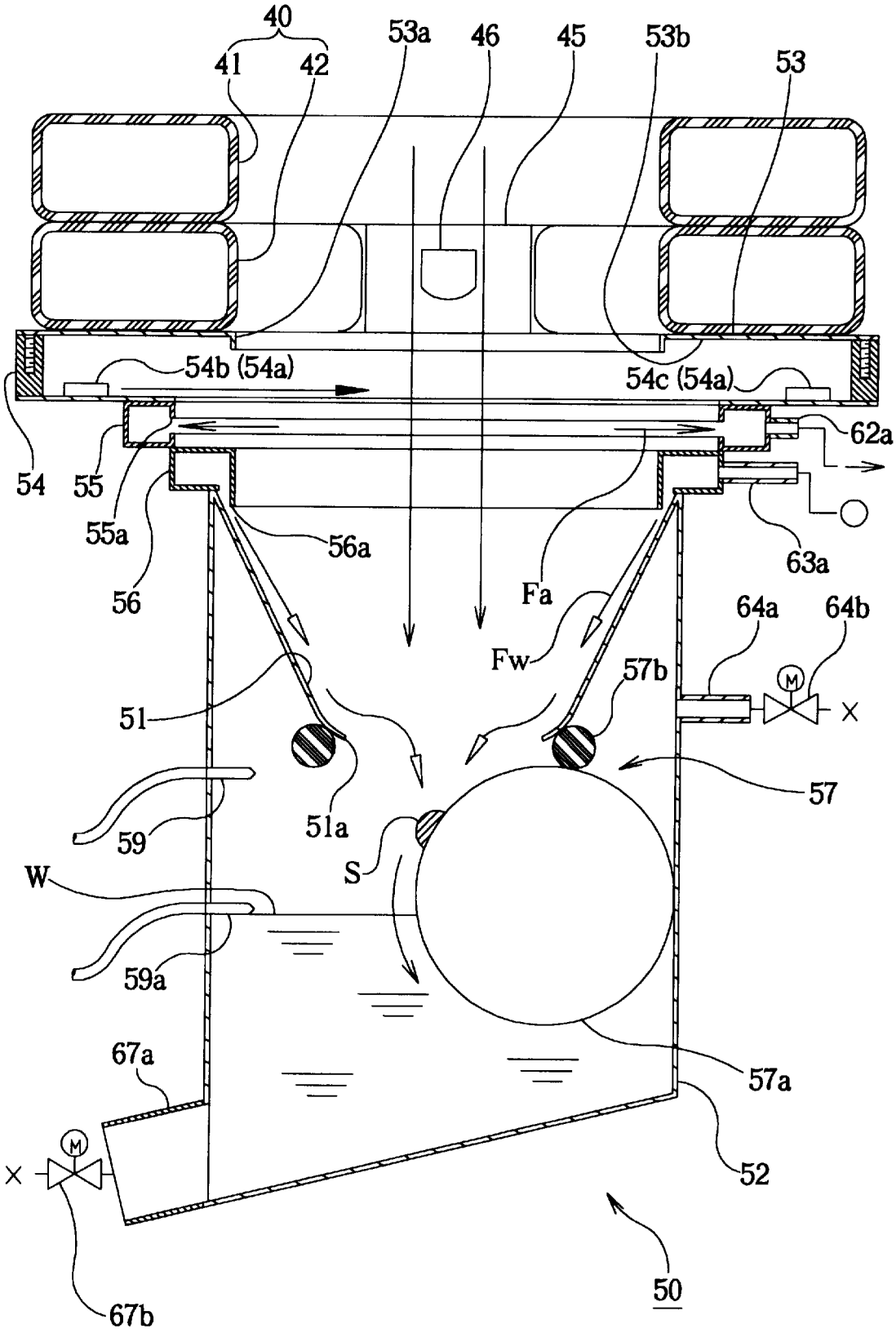
FIG. 10 is a diagram showing a second embodiment of the present invention, which corresponds to FIG. 4.

In the above-described embodiment, the drainage control means for lowering the level of water in the water tank 52 of the toilet 50 is composed of the first drainpipe 66*a* connected to a middle part in the vertical direction of the water tank, the second drainpipe 67*a* connected to the lower part of the water tank, and the first and second drain valves 66*b*, 67*b*. However, as shown in a second embodiment shown in FIG. 10, the drainage control means may be made of the second drainpipe 67*a* and the second drain valve 67*b* connected to the lower part of the water tank and a waste-water level sensor 59*a* provided in a middle part in the vertical direction of the water tank. That is to say, the second drain valve 67*b* is once closed when the waste-water level sensor 59*a*, similar to the above-described water-level sensor 59, detects the surface of the water W, so that the floating ball 57*a* certainly turns in the water W with the odor-sealing vale 57 opened.

Figure 11:
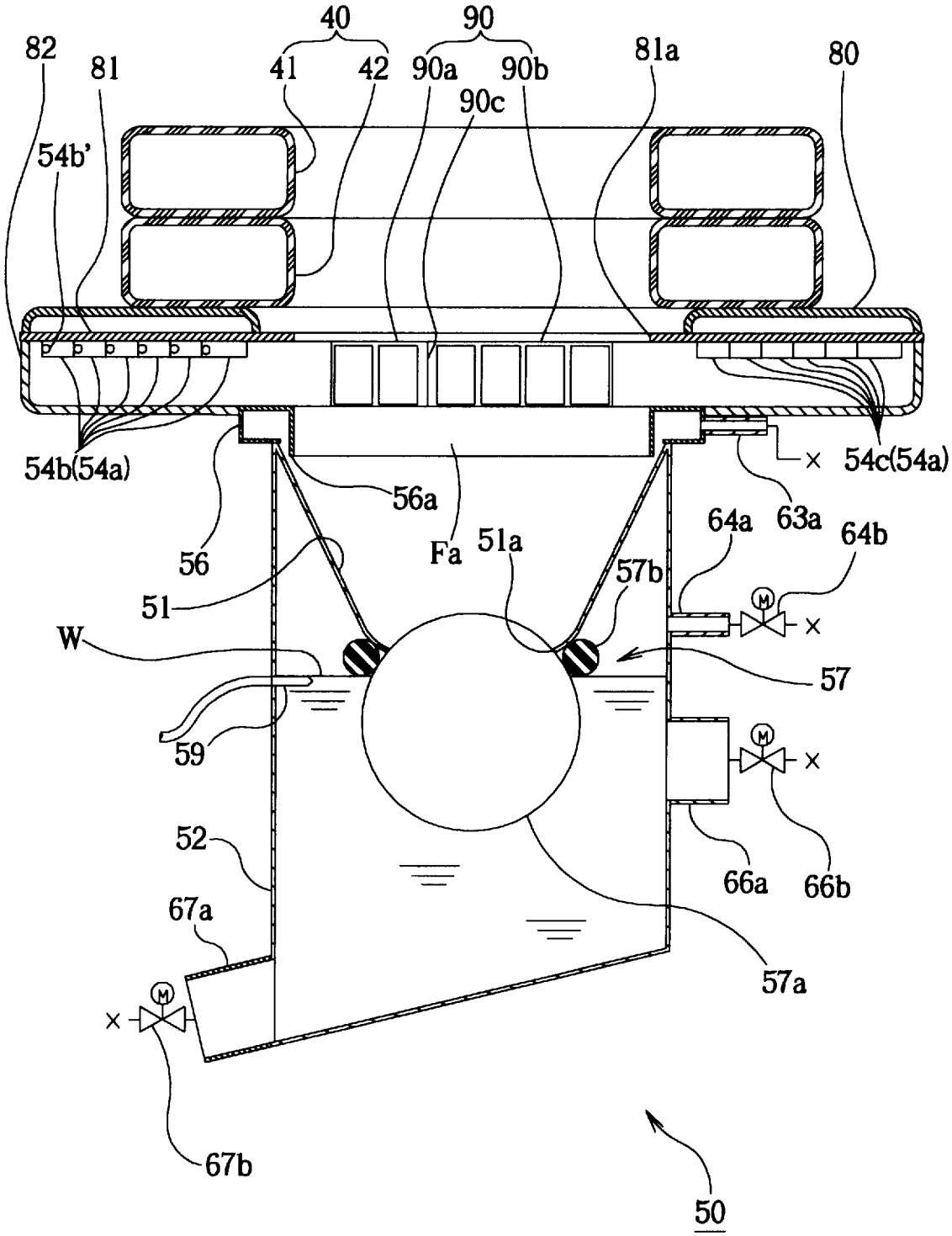
FIG. 11 is a diagram showing a third embodiment of the present invention, which corresponds to FIG. 3.
Figure 12:
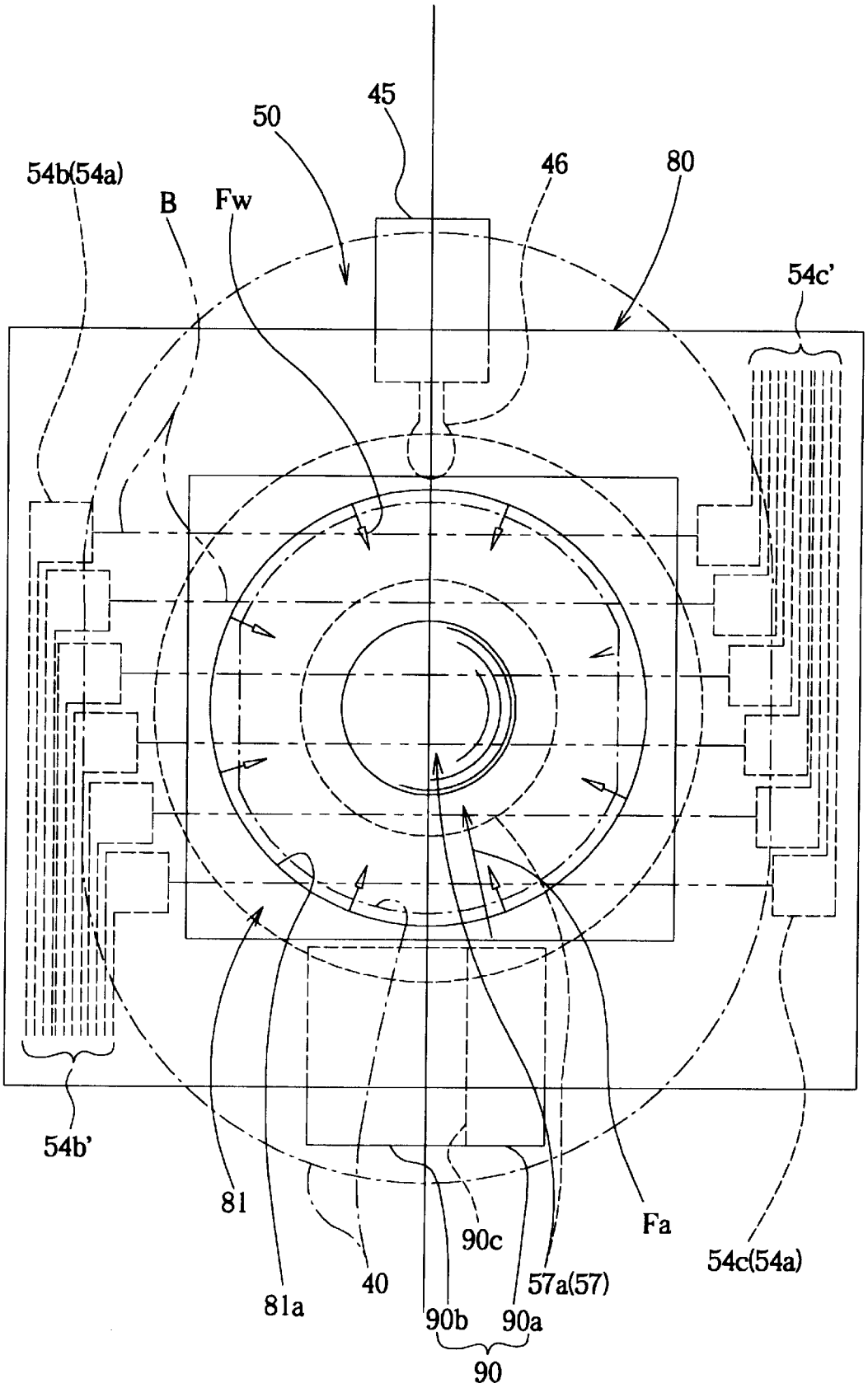
FIG. 12 is a diagram showing the third embodiment of the present invention, which corresponds to FIG. 7.

A third embodiment shown in FIGS. 11 and 12 differs from the first embodiment in the shape of the rest 80 and the air passage 90 and the shape and arrangement of the vent holes 54*a* and the cleaner 45. The rest 80 on which the toilet seat 40 is rested is formed by combining channel-shaped steel plates with short flanges, in section, into a rectangular shape. An opened circular plate 81 having a circular upper opening 81*a* is provided under it, and a sealing member 82 is provided between the periphery of the opened circular plate 81 and the periphery of the ring-shaped water-supply frame 56 to seal off this part.

In this embodiment, the plurality of light-emitting parts 54*b* and light-receiving parts 54*c* of the falling matter sensor 54*a* are arranged on the under side of the rest 81 on the right and left sides to face each other across the upper opening 81*a*, with the plurality of optical paths B from the light-emitting parts 54*b* to the light-receiving parts 54*c* arranged in the lateral direction with respect to the bed, or perpendicular to the elongate direction of the bed, to extend across the entirety of the opening of the toilet 50. The light-emitting parts 54*b* and the light-receiving parts 54*c* have emitting-side signal lines 54*b*' and receiving-side signal lines 54*c*', respectively. The plurality of light-emitting parts 54*b* or light-receiving parts 54*c* are arranged obliquely with respect to the optical paths B, with adjacent ones of light-emitting parts 54*b*, or light-receiving parts 54*c*, shifted from each other for the width of the signal lines. Further, the row of light-emitting parts 54*b* and the row of light-receiving parts 54*c* are arranged almost point-symmetrically, seen in the plane view, with resect to the center axis of the toilet 50 so that the lengths of the optical paths B between the oppositely arranged light-emitting parts 54*b* and light-receiving parts 54*c* are almost uniform in the entire rows of the falling matter sensor 54*a*, which enables steady sensitivity in the entire rows of the falling matter sensor 54*a*.

While the cleaner 45 is similar to that of the above-described embodiments, it is located under the opened circular plate 81 on the side of the head of the patient lying on the bed. Unlike that shaped in a ring-like form in the above-described embodiments, the air passage 90 has a hot-air sending part 90*a* for blowing hot air from one direction toward the buttocks of the patient as shown by the arrow Fa and an air evacuating part 90*b* for drawing odors inside the sealing member 82 to one direction. The hot-air sending part 90*a* and the air evacuating part 90*b* are located adjacent each other with the boundary 90*b* between. The hot-air sending part 90*a* contains or is connected to the air-sending blower 62*b* and the air heater 62*d*, and the air evacuating part 90*b* contains or is connected to the air-evacuating blower 62*c*. This air passage 90 is provided under the opened circular plate 81 on the side closer to the feet of the patient lying on the bed, which intensively blows hot air to the buttocks from one direction to enhance the drying efficiency as compared with the first embodiment. As can be seen from the drawing, the cleaner 45 and air passage 90 are arranged in the direction crossing the optical paths B at the level almost equal to the level of the falling matter sensor 54*a*, which reduces the height of the entirety of the toilet 50 than that in the first embodiment.

The sealing member 82 is cut only in the parts for accommodating the cleaner 45 and the air passage 90, and the inside of the sealing member 82 is appropriately isolated from the outside. This, coupled with exhaust of odor by the air evacuating part 90*b*, remarkably prevents the escape of odor from the toilet 50. Further, when the hot-air sending part 90*a* and the air evacuating part 90*b* are located across the upper opening 81*a* in the longitudinal direction or when the air evacuating part 90*b* is formed in a ring shape as that in the first embodiment and the air evacuating part 90*b* evacuates air at the same time when the hot-air sending part 90*a* blows hot air, it is also possible to prevent the escape of the hot air. If there is no restriction of space, the cleaner 45 and the air passage 90 may be provided on the same side.

Figure 13:
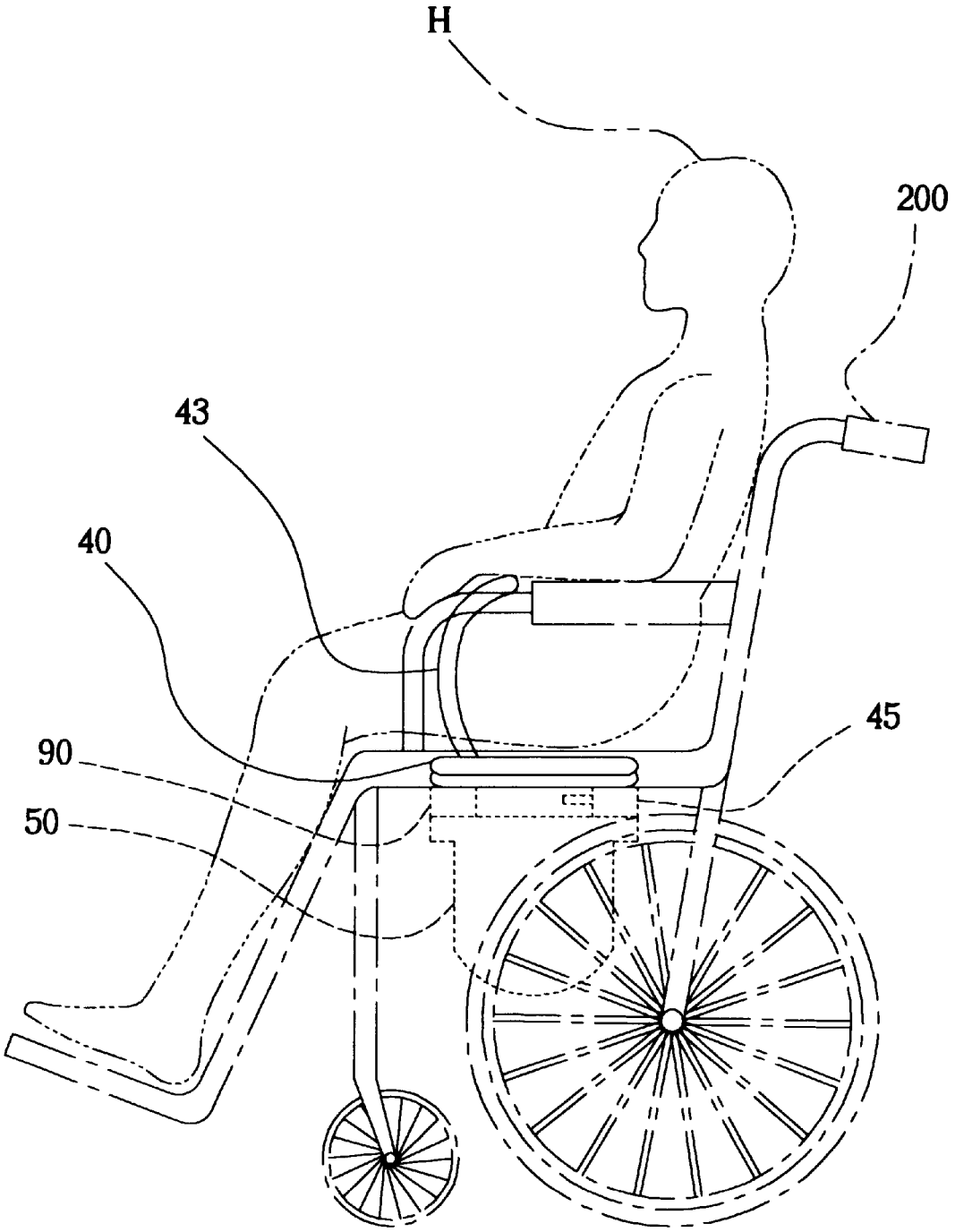
FIG. 13 is a side view showing a fourth embodiment of the present invention, in which the flush toilet is installed in a wheelchair.

As shown in FIG. 13, in a fourth embodiment of the present invention, the toilet 50 of the third embodiment is installed in a wheelchair 200. The cover 43 of the toilet seat 40 can be applied to a patient H sitting on the wheelchair 200 to implement the above-described measure while the patient H is moving.

In the above-described embodiments, the water-supply control means is composed of the second water-supply pipe 64*a*, the water-supply valve 64*b*, and the water-level sensor 59. However, the water-level sensor 59 may be replaced by timer means for measuring the water-supplying time or a water meter for measuring the amount of supplied water as the water-supply control means.

In the above-described embodiments, the spherical body 57*a* serving as the valve member of the odor-sealing valve 57 is made of a stainless hollow ball. However, other material having smaller specific gravity than water and processed so that waste matter adhering to the surface can be easily cleaned away can be used for the spherical body 57*a*, such as a styrene foam ball coated with metal by evaporation, for example. Or, it may be constructed by treating the surface of a hollow sphere of synthetic resin or metal to facilitate removal of stains by Teflon resin treatment, for example. Experiments by the inventor showed that a hollow ball of stainless is the most suitable in respect to easy production, durability, and easy removal of waste matter.

In the above-described embodiments, the falling matter sensor 54*a*, the cleaner 45, and the air passage 55, 90 are provided "above" the toilet bowl 51 to keep these parts away from cleaning water and the like. However, if a measure can be taken for cleaning water, these elements may be provided "over" the toilet bowl 51 itself.

IN INDUSTRIAL APPLICABILITY

As described above, the flush toilet of the present invention can be used in a care bed and a wheelchair. Further, the flush toilet of the present invention can be used as a flush toilet on an air plane, train, etc., as well.

What is claimed is:

1. A flush toilet having a toilet bowl (51), a drainage part (66*a,* 67*a*), and an odor-sealing valve (57) for shutting off the drainage part (66*a,* 67*b*) from the toilet bowl (51), the flush toilet comprising: a water tank (52) provided below said toilet bowl (51), said odor-sealing valve (57) comprising a spherical body (57*a*) floating in the water tank (52) and a ring-shaped packing (57*b*) located near a lower opening (51*a*) of the toilet bowl (51) and capable of coming into close contact with said spherical body (57*a*); drainage control means (66*a,* 67*a,* 66*b,* 67*b,* 59*a*) capable of lowering water level in said water tank (52) to open said odor-sealing valve (57); and water-supply control means (64*a,* 64*b,* 59) capable of raising the water level in said water tank to close said odor-sealing valve (57).

2. The flush toilet according to claim 1, further comprising water-supply means (56, 63*a,* 63*b*) for downwardly flushing cleaning water from above said toilet bowl (51), wherein, when said odor-sealing valve (57) is opened, the cleaning water falls down onto said spherical body (57*a*) through the lower opening (51*a*) of said toilet bowl (51).

3. The flush toilet according to claim 1, wherein said spherical body (57*a*) and said packing (57*b*) come to abut on each other before the water level reaches the lower opening (51*a*) of said toilet bowl (51).

4. The flush toilet according to claim 1, further comprising an air passage unit (55, 90) provided above or over said toilet bowl (51), for blowing hot air in normal state and evacuating an odor during defecation.

5. The flush toilet according to claim 4, further comprising a sensor (54*a*) provided above or over said toilet bowl (51), for sensing waste matter falling, wherein when said sensor (54*a*) senses falling waste matter, said drainage control means (66*a,* 67*a,* 66*b,* 67*b,* 59*a*) opens said odor-sealing valve (57), said water-supply means (56, 63*a,* 63*b*) flushes the cleaning water, and said air passage unit (55, 90) evacuates the odor.

6. The flush toilet according to claim 1, further comprising an optical sensor (54*a*) provided above or over said bowl (51), for sensing waste matter falling in the toilet when an optical path (B) from a light-emitting part (54*b*) to a light-receiving part (54*c*) is intercepted, wherein, as said sensor (54*a*) senses waste matter falling, control to said drainage control means (66*a,* 67*a,* 66*b,* 67*b,* 59*a*) starts.

7. The flush toilet according to claim 6, further comprising an air passage unit (90) for at least blowing hot air from one direction toward buttocks of a user and a cleaning device (45) for cleaning said buttocks, wherein said air passage unit (90) and said cleaning device (45) are arranged above or over said toilet bowl (51), in a direction intersecting said optical path (B) at a level approximately equal to that of said sensor (54*a*).

8. The flush toilet according to any of claims 1 to 7, wherein said drainage control means (66*a,* 67*a,* 66*b,* 67*b*) comprises a first drainpipe (66*a*) and a first valve (66*b*) connected to a middle part in height direction of said water tank (52), and a second drainpipe (67*a*) and a second valve (67*b*) connected to bottom of said water tank (52), and wherein said second valve (67*b*) is opened after said first valve (66*b*) is opened.

9. A care bed apparatus comprising a care bed (2) having the flush toilet as defined in any of claims 1 to 7, a bathtub (3) located under the care bed (2), and moving means (9) for laterally moving said care bed (2).

10. A care bed apparatus comprising a care bed (2) having the flush toilet as defined in any of claims 1 to 7, a bathtub (3) located under the care bed (2), moving means (9) for laterally moving said care bed (2), and a lift (5) for lifting up or down a patient.

* * * * *